US010782023B2

(12) United States Patent
Lavon et al.

(10) Patent No.: US 10,782,023 B2
(45) Date of Patent: Sep. 22, 2020

(54) FLAME SCANNER WITH PHOTODIODE COUPLED TO A SIGNAL CONDITIONER TO GENERATE AN OUTPUT SIGNAL EMULATING AN OUTPUT SIGNAL OF AN ULTRAVIOLET TUBE FLAME SCANNER

(71) Applicant: Carrier Corporation, Palm Beach Gardens, FL (US)

(72) Inventors: Ronie Lavon, Derry, NH (US); William Glasheen, Derry, NH (US); Dan Melanson, Manchester, NH (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 71 days.

(21) Appl. No.: 16/316,560

(22) PCT Filed: Jul. 11, 2017

(86) PCT No.: PCT/US2017/041453

§ 371 (c)(1),
(2) Date: Jan. 9, 2019

(87) PCT Pub. No.: WO2018/013514

PCT Pub. Date: Jan. 18, 2018

(65) Prior Publication Data

US 2019/0226677 A1 Jul. 25, 2019

Related U.S. Application Data

(60) Provisional application No. 62/360,714, filed on Jul. 11, 2016.

(51) Int. Cl.
*F23N 5/08* (2006.01)
*F23N 5/24* (2006.01)

(52) U.S. Cl.
CPC ..... *F23N 5/082* (2013.01); *F23N 5/24* (2013.01); *F23N 2229/12* (2020.01)

(58) Field of Classification Search
CPC ..... F23N 5/08; F23N 5/082; F23N 2223/00; F23N 2229/00; F23N 12/51242; G08B 17/00; G08B 17/113
(Continued)

(56) References Cited

U.S. PATENT DOCUMENTS 3,846,061 A 11/1974 Wright et al.
4,039,844 A 8/1977 MacDonald
(Continued)

FOREIGN PATENT DOCUMENTS

DE 10205198 A1 8/1966
GB 1039594 A 8/1966
(Continued)

OTHER PUBLICATIONS

Apupetit, Nicolas, "Signal Conditioning for a UV Sensor", STMicroelectronics, AN4451 Application note, 2014, 15 pages.
(Continued)

*Primary Examiner* — Que Tan Le
(74) *Attorney, Agent, or Firm* — Cantor Colburn LLP

(57) ABSTRACT

A flame scanner (10) includes terminals (32) for connection to a controller (50) The flame scanner includes a photodiode (14) to generate a detection signal; and a signal conditioner (20) coupled to the photodiode, the signal conditioner to generate an output signal across the terminals, the output signal emulating an output of an ultraviolet tube flame scanner.

15 Claims, 2 Drawing Sheets

(58) Field of Classification Search
USPC ..... 250/554, 214 R
See application file for complete search history.

(56) References Cited

U.S. PATENT DOCUMENTS

| | | | | |
|---|---|---|---|---|
| 4,591,725 | A | 5/1986 | Bryant | |
| 5,194,728 | A | 3/1993 | Peterson | |
| 5,256,057 | A * | 10/1993 | Grow | F23N 5/082 431/79 |
| 5,589,682 | A | 12/1996 | Brown et al. | |
| 6,013,919 | A | 1/2000 | Schneider et al. | |
| 6,111,511 | A | 8/2000 | Sivathanu et al. | |
| 6,404,342 | B1 | 6/2002 | Planer et al. | |
| 6,472,669 | B1 | 10/2002 | Chase et al. | |
| 2014/0353473 | A1 | 12/2014 | Stoica et al. | |

FOREIGN PATENT DOCUMENTS

| | | | |
|---|---|---|---|
| KR | 100675363 | B1 | 1/2007 |
| WO | 0046550 | A1 | 8/2000 |
| WO | 0190651 | A1 | 11/2001 |

OTHER PUBLICATIONS

International Search Report and Written Opinion for application PCT/2017/041453, dated Jul. 11, 2016, 10 pages.

Microchip Technology Inc., "Signal Chain Design Guide" Analog & Interface Solutions, Fall 2012, 34 pages.

Mitsubishi Heavy Industries, Ltd., "Mitsubishi Infrared Type Flame Detector IR-S Operation Manual", DIASYS Solutions, First Edition, available at: https://www.mhi-global.com/products/pdf/diasys_srvc_document-download_03.pdf, accessed Jan. 9, 2019, 56 pages.

Taos Inc., "Shaping the Future of Light Sensing Solutions", available at: http://datasheet.octopart.com/TSL12T-TAOS-datasheet-164259.pdf, 2007, 7 pages.

Texas Instruments, "Light-to-Frequency Converter TSL220", SOES003—Aug. 1990—Revised Jun. 1991, 12 pages.

Texas Instruments, "Light-to-Frequency Converter TSL235", SOES012—Sep. 1994, 7 pages.

Vandermeer, Willy, "Flame Safeguard Controls in Multi-Burner Environments" WV-96, Apr. 1998, Internet; available at: http://www.fireye.com/Documents/WV-96.pdf, 33 pgs.

* cited by examiner

FLAME SCANNER WITH PHOTODIODE COUPLED TO A SIGNAL CONDITIONER TO GENERATE AN OUTPUT SIGNAL EMULATING AN OUTPUT SIGNAL OF AN ULTRAVIOLET TUBE FLAME SCANNER

TECHNICAL FIELD

The subject matter disclosed herein relates generally to the field of flame scanners, and more particularly, to a flame scanner having a photodiode for flame detection.

BACKGROUND

Flame scanners are used to detect the presence of a flame in equipment such as furnaces, boilers, etc. Many existing flame scanners use an ultraviolet (UV) tube to sense the presence of a flame. The UV tube generates a pulsed output, where the pulse frequency is proportional to the intensity of the UV light that hits the UV tube. The pulses are used by a controller as an indicator of flame presence or not.

The use of a UV tube in a flame scanner has several drawbacks. One drawback is that the UV tube has a short life span (1-10 years). Another drawback is that the UV tube can have an unsafe failure mode. A common failure mode is "runaway" triggering, which indicates a flame is present where there is not a flame present.

BRIEF DESCRIPTION

According to one embodiment, a flame scanner includes terminals for connection to a controller, the flame scanner comprising: a photodiode to generate a detection signal; and a signal conditioner coupled to the photodiode, the signal conditioner to generate an output signal across the terminals, the output signal emulating an output of an ultraviolet tube flame scanner.

In addition to one or more of the features described above, or as an alternative, further embodiments may include wherein the signal conditioner comprises a pulse generator, the pulse generator generating the output signal in response to the detection signal.

In addition to one or more of the features described above, or as an alternative, further embodiments may include wherein the signal conditioner comprises an amplifier to receive the detection signal and generate a voltage in response to the detection signal.

In addition to one or more of the features described above, or as an alternative, further embodiments may include the signal conditioner comprises a voltage-to-frequency converter to receive the voltage and generate a waveform in response to the voltage.

In addition to one or more of the features described above, or as an alternative, further embodiments may include wherein the pulse generator generates the output signal in response to the waveform.

In addition to one or more of the features described above, or as an alternative, further embodiments may include wherein the pulse generator comprises a switching element that opens and closes in response to the waveform, the switching element connected across the terminals.

In addition to one or more of the features described above, or as an alternative, further embodiments may include wherein the pulse generator comprises a voltage limiting element to control voltage across the terminals.

In addition to one or more of the features described above, or as an alternative, further embodiments may include wherein the signal conditioner comprises a voltage converter to convert a voltage from the terminals to a supply voltage for the amplifier and voltage-to-frequency converter.

In addition to one or more of the features described above, or as an alternative, further embodiments may include wherein the output signal oscillates between a high value and a low value with a frequency proportional to an intensity of flame sensed at the photodiode.

In addition to one or more of the features described above, or as an alternative, further embodiments may include wherein the signal conditioner operates on a high voltage applied across the terminals.

In addition to one or more of the features described above, or as an alternative, further embodiments may include wherein the high voltage is about 300 volts.

In addition to one or more of the features described above, or as an alternative, further embodiments may include wherein the high voltage is substantially the same voltage used for the ultraviolet tube flame scanner.

In addition to one or more of the features described above, or as an alternative, further embodiments may include wherein the signal conditioner draws a low current when a flame is not present at the photodiode.

In addition to one or more of the features described above, or as an alternative, further embodiments may include wherein the low current is about 100 microamps.

In addition to one or more of the features described above, or as an alternative, further embodiments may include wherein the low current is lower than a flame presence trigger limit of the controller.

Technical effects of embodiments of the disclosure include a flame scanner that includes a photodiode for detecting flame presence and a signal conditioner that generates an output signal that is similar to that of a UV tube flame scanner.

These and other advantages and features will become more apparent from the following description taken in conjunction with the drawings.

DETAILED DESCRIPTION

Figure 1:
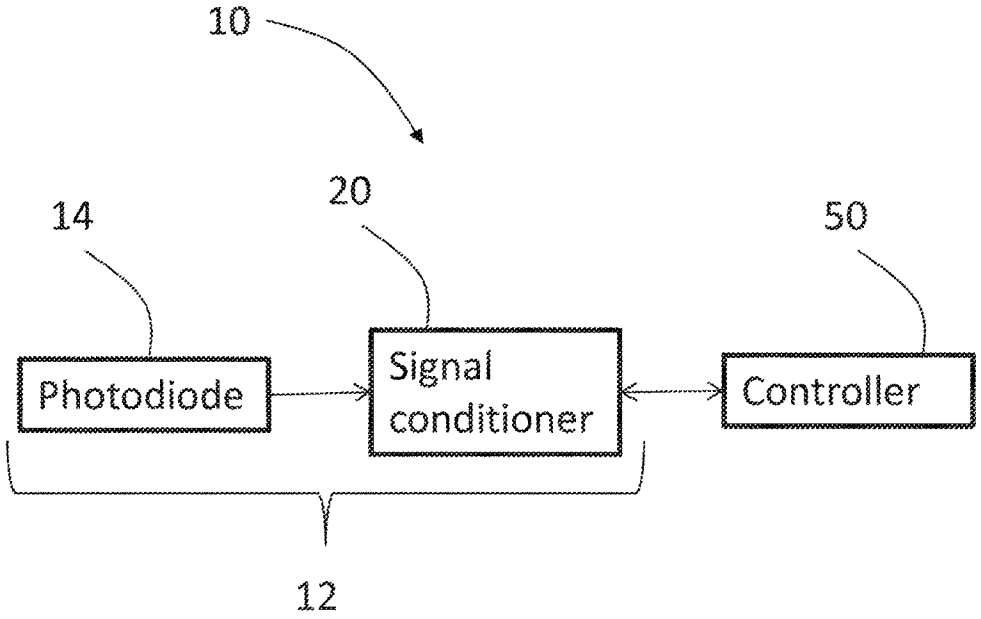
FIG. 1 is a block diagram of a flame sensing system in an embodiment.

FIG. 1 is a block diagram of a flame sensing system 10 in an embodiment. The flame sensing system 10 includes a flame scanner 12 including a photodiode 14 and a signal conditioner 20. The photodiode 14 generates a detection signal in the presence of a flame. The photodiode 14 may be implemented using known photodiodes (e.g., silicon, silicon carbide, indium gallium arsenide, etc.). The photodiode 14 may selectively generate a detection signal in response to certain wavelengths of light, such that the photodiode 14 only generates a detection signal when a flame is present.

The signal conditioner 20 receives the detection signal from the photodiode 14 and generates an output signal that is used by controller 50 to determine the presence of a flame. The signal conditioner 20 receives power from the controller 50 and operates on substantially the same high voltage that would be typically provided to a UV tube (e.g., about 300 volts AC or DC). The signal conditioner 20 also generates an output signal that is similar to the output signal of a UV tube.

Therefore, the flame scanner 12 can replace an existing UV tube without any modifications to controller 50.

The signal conditioner 20 draws low current (e.g., about 100 microamps) when a flame is not present. The controller 50 will trigger and indicate a flame is present if a current exceeding a limit is drawn by the signal conditioner 20. Hence, the signal conditioner 20 runs on a very small amount of current, so as not to cause a false trigger at controller 50.

Figure 2:
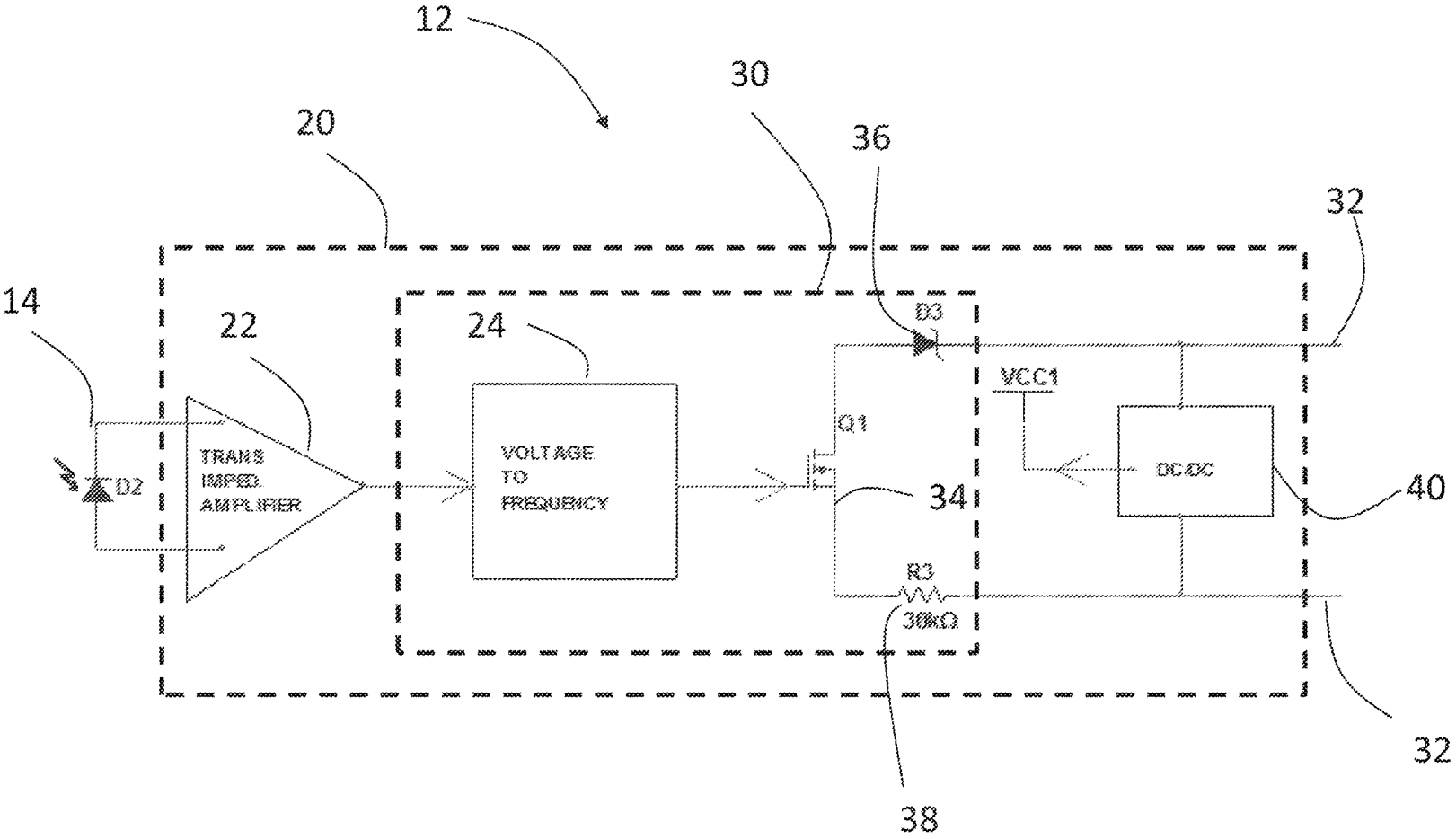
FIG. 2 is a schematic diagram of a flame scanner in an embodiment.

FIG. 2 is a schematic diagram of the flame scanner 12 in an embodiment. The signal conditioner 20 includes an amplifier 22 which receives the detection signal from the photodiode 14. The amplifier 22 may be a transimpedance amplifier (i.e., current to voltage converter) that generates a voltage in response to the detection signal (i.e., a current) from the photodiode 14. The magnitude of the voltage output by amplifier 22 is proportional to the current output by the photodiode 14. The output of amplifier 22 is provided to a pulse generator 30. The pulse generator 30 produces an output signal at terminals 32, which connect the flame scanner 12 to the controller 50.

The pulse generator 30 includes a voltage-to-frequency converter 24 that generates a waveform (e.g., sinusoid, square wave, etc.) having a frequency proportional to the voltage output by the amplifier 22. The flame scanner 12 is powered by controller 50 at terminals 32, receiving a high voltage (e.g., about 300 volts AC or DC) across terminals 32 and drawing a low current (e.g., about 100 microamps). The pulse generator 30 includes a switching element 34 (e.g., a transistor) that opens and closes in response to the waveform from the voltage-to-frequency converter 24. The switching element 34 is connected across terminals 32, so that the output signal at terminals 32 will oscillate between a high value when switching element 34 is open (e.g., about 300 AC or volts DC) to a low value (e.g., about 170 volts AC or DC) when switching element 34 is closed. The frequency of the output signal at terminals 32 is proportional to the intensity of the flame sensed at photodiode 14 (e.g., the larger the output current at photodiode 14, the higher the frequency of the output signal at terminals 32).

The voltage across terminals 32 is prevented from being zero by voltage limiting elements, including a zener diode 36 and resistance 38. By selecting values for the zener diode 36 and resistance 38, the output signal at terminals 32 emulates the output signal of a UV tube flame scanner. An example UV tube flame scanner may produce pulses that oscillate between about 300 volts and about 170 volts. This pulse train is emulated by the pulse generator 30, so that the controller 50 does not require any modification to work with the flame scanner 12. Components of the pulse generator 30 may be adjusted to emulate different types of UV tubes.

The signal conditioner 20 includes a voltage converter 40 used to power the amplifier 22 and voltage-to-frequency converter 24. The voltage converter 40 receives input power at terminals 32 (e.g., about 300 volts AC or DC) and converts the input power to a supply voltage suitable for use by the amplifier 22 and the voltage-to-frequency converter 24 (e.g., 5 or 12 volts DC). The voltage converter 40 consumes low current (e.g., about 100 microamps). If excess current is drawn by the signal conditioner 20, the controller 50 will indicate this as the presence of a flame, resulting in a false trigger. The current drawn by the signal conditioner 20 should be lower than a flame presence trigger limit of the controller 50.

Embodiments provide a solid state flame scanner having a much longer life span than conventional UV tube flame scanners. If the photodiode fails, it fails to produce a detection signal, which means the flame scanner indicates that no flame is present (i.e., safe failure mode). The solid state flame scanner generates an output signal that emulates a UV tube flame scanner, and as such, no modifications are needed to the controller to replace the UV tube flame scanner with the solid state flame scanner.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

The invention claimed is:

1. A flame scanner including terminals for connection to a controller, the flame scanner comprising:

a photodiode to generate a detection signal; and a signal conditioner coupled to the photodiode, the signal conditioner to generate an output signal across the terminals, the output signal emulating an output of an ultraviolet tube flame scanner.

2. The flame scanner of claim 1 wherein:

the signal conditioner comprises a pulse generator, the pulse generator generating the output signal in response to the detection signal.

3. The flame scanner of claim 2 wherein:

the signal conditioner comprises an amplifier to receive the detection signal and generate a voltage in response to the detection signal.

4. The flame scanner of claim 3 wherein:

the signal conditioner comprises a voltage-to-frequency converter to receive the voltage and generate a waveform in response to the voltage.

5. The flame scanner of claim 4 wherein:

the pulse generator generates the output signal in response to the waveform.

6. The flame scanner of claim 5 wherein:

the pulse generator comprises a switching element that opens and closes in response to the waveform, the switching element connected across the terminals.

7. The flame scanner of claim 6 wherein:

the pulse generator comprises a voltage limiting element to control voltage across the terminals.

8. The flame scanner of claim 4 wherein:

the signal conditioner comprises a voltage converter to convert a voltage from the terminals to a supply voltage for the amplifier and voltage-to-frequency converter.

9. The flame scanner of claim 1 wherein:

the output signal oscillates between a high value and a low value with a frequency proportional to an intensity of flame sensed at the photodiode.

10. The flame scanner of claim 1 wherein:

the signal conditioner operates on a high voltage applied across the terminals.

11. The flame scanner of claim 10 wherein:

the high voltage is about 300 volts.

12. The flame scanner of claim 10 wherein:

the high voltage is substantially the same voltage used for the ultraviolet tube flame scanner.

13. The flame scanner of claim 1 wherein:
the signal conditioner draws a low current when a flame is not present at the photodiode.

14. The flame scanner of claim 13 wherein:
the low current is about 100 microamps.

15. The flame scanner of claim 13 wherein:
the low current is lower than a flame presence trigger limit of the controller.

* * * * *